US009904186B2

(12) United States Patent
Kitagawa et al.

(10) Patent No.: US 9,904,186 B2
(45) Date of Patent: Feb. 27, 2018

(54) ELECTROPHOTOGRAPHIC PHOTORECEPTOR, METHOD FOR MANUFACTURING SAME, AND ELECTROPHOTOGRAPHIC APPARATUS USING SAME

(75) Inventors: Seizo Kitagawa, Matsumoto (JP); Yasushi Tanaka, Matsumoto (JP); Shinjiro Suzuki, Matsumoto (JP); Hiroshi Emori, Matsumoto (JP); Kazuki Nebashi, Matsumoto (JP)

(73) Assignee: FUJI ELECTRIC CO., LTD., Kawasaki-Shi (JP)

( * ) Notice: Subject to any disclaimer, the term of this patent is extended or adjusted under 35 U.S.C. 154(b) by 0 days.

(21) Appl. No.: 14/232,900

(22) PCT Filed: Aug. 5, 2011

(86) PCT No.: PCT/JP2011/067933

§ 371 (c)(1),
(2), (4) Date: Jan. 14, 2014

(87) PCT Pub. No.: WO2013/021430

PCT Pub. Date: Feb. 14, 2013

(65) Prior Publication Data

US 2014/0199619 A1 Jul. 17, 2014

(51) Int. Cl.

| | |
|---|---|
| ***G03G 5/047*** | (2006.01) |
| ***G03G 5/05*** | (2006.01) |
| ***G03G 5/06*** | (2006.01) |
| ***B05D 1/18*** | (2006.01) |
| ***G03G 5/04*** | (2006.01) |

(52) U.S. Cl.

CPC ..... *G03G 5/047* (2013.01); *B05D 1/18* (2013.01); *G03G 5/04* (2013.01); *G03G 5/0503* (2013.01); *G03G 5/0525* (2013.01); *G03G 5/0564* (2013.01); *G03G 5/0696* (2013.01)

(58) Field of Classification Search

CPC .. G03G 5/0525; G03G 5/0696; G03G 5/0503; G03G 5/047; G03G 5/0618; G03G 5/0614; G03G 5/0564

USPC ..... 430/58.05, 59.5, 130, 133, 58.85, 58.65, 430/58.25, 59.6

See application file for complete search history.

(56) References Cited

U.S. PATENT DOCUMENTS

| | | | | |
|---|---|---|---|---|
| 4,792,507 | A | 12/1988 | Yoshihara et al. | |
| 4,882,253 | A | 11/1989 | Kato et al. | |
| 5,324,610 | A | 6/1994 | Tanaka et al. | |
| 5,837,410 | A * | 11/1998 | Nakamura et al. | 430/58.05 |
| 6,933,090 | B2 * | 8/2005 | Inagaki | G03G 5/14726 430/58.05 |
| 7,041,419 | B2 * | 5/2006 | Tokutake | G03G 5/047 430/58.05 |
| 7,678,517 | B2 * | 3/2010 | Lin | G03G 5/0614 430/56 |
| 8,518,615 | B2 | 8/2013 | Tanaka | |
| 8,518,617 | B2 * | 8/2013 | Miyamoto | G03G 5/051 399/159 |
| 2011/0091799 | A1 | 4/2011 | Nakamura et al. | |
| 2011/0183246 | A1 * | 7/2011 | Zhu et al. | 430/58.65 |
| 2012/0003574 | A1 * | 1/2012 | Kitagawa | G03G 5/047 430/56 |
| 2013/0040234 | A1 | 2/2013 | Zhang et al. | |

FOREIGN PATENT DOCUMENTS

| | | | |
|---|---|---|---|
| EP | 0456829 | A1 | 11/1991 |
| EP | 0744666 | A2 | 11/1996 |
| JP | S50-023231 | A | 3/1975 |
| JP | 03-15074 | * | 1/1991 |
| JP | H03-233885 | A | 10/1991 |
| JP | 3-256050 | A | 11/1991 |
| JP | H04-241359 | A | 8/1992 |
| JP | H04-242259 | A | 8/1992 |
| JP | H05-12702 | B2 | 2/1993 |

(Continued)

OTHER PUBLICATIONS

Windholz, M., et al., ed., The Merck Index, 9th edition, Merck& Co., Inc, NJ (1977), No. 9812, pp. 499 and 791.*

IBM Technical Disclosure Bulletin TDB Acc. No. NA80013082, copyright 1980.*

Japanese Patent Office (JPO) English-language abstract describing JP 03-15074, copyright 1991.*

Derwent abstract describing JP 03-15074, Acc. No. 1991-068106, entered Derwent in 1991, copyright 2015 Thomas Reuters.*

Whelan, T., ed., Polymer Technology Dictionary, Chapman & Hall, London (1994), p. 256.*

Diamond, A.S., ed., Handbook of Imaging Materials, Marcel Dekker, Inc. NY (1991), pp. 427-431.*

Japanese Office Action with translation dated Feb. 3, 2015.

Japanese Office Action with translation dated Apr. 19, 2016.

*Primary Examiner* — Janis L Dote

(74) *Attorney, Agent, or Firm* — Rabin & Berdo, P.C.

(57) ABSTRACT

A layered, positively-charged electrophotographic photoreceptor, a method for manufacturing the photoreceptor and an electrophotographic apparatus using the photoreceptor are disclosed. The layered, positively-charged electrophotographic photoreceptor includes a conductive support on which is provided a sequential stack composed of a charge transport layer containing at least a first hole transport material and a first binder resin; and a charge generation layer containing at least a charge generation material, a second hole transport material, an electron transport material, and a second binder resin, wherein the charge generation layer and the charge transport layer have a total amount of residual solvents that is 50 $\mu g/cm^2$ or less. The photoreceptor is highly sensitive, highly durable, and has excellent image qualities including low image defects from cracks generated due to image memory or contact contamination. The photoreceptor is applicable to a high-resolution and high-speed positively-charged electrophotographic apparatuses and provides excellent operational stability.

9 Claims, 5 Drawing Sheets

(56) References Cited

FOREIGN PATENT DOCUMENTS

| | | | |
|---|---|---|---|
| JP | H05-45915 | A | 2/1993 |
| JP | H05-30262 | B2 | 5/1993 |
| JP | H05-47822 | B2 | 7/1993 |
| JP | 7-160017 | A | 6/1995 |
| JP | H09-43887 | A | 2/1997 |
| JP | H09-90545 | A | 4/1997 |
| JP | 2000-338688 | A | 12/2000 |
| JP | 2002-296820 | A | 10/2002 |
| JP | 2002-311606 | A | 10/2002 |
| JP | 2002-323781 | A | 11/2002 |
| JP | 2003-186227 | A | 7/2003 |
| JP | 2004-240056 | A | 8/2004 |
| JP | 2004-252052 | A | 9/2004 |
| JP | 2005-258133 | A | 9/2005 |
| JP | 2007-121733 | A | 5/2007 |
| JP | 2007-163523 | A | 6/2007 |
| JP | 2007-188003 | A | 7/2007 |
| JP | 2007-256768 | A | 10/2007 |
| JP | 2009-288569 | A | 12/2009 |
| JP | 2011-094101 | A | 5/2011 |
| KR | 10-2010-0097226 | A | 9/2010 |
| WO | WO-2009/104571 | A1 | 8/2009 |
| WO | WO-2009-104571 | A1 * | 8/2009 |
| WO | WO-2010/007930 | A1 * | 1/2010 |
| WO | WO 2011-093410 | A1 | 8/2011 |

* cited by examiner

ELECTROPHOTOGRAPHIC PHOTORECEPTOR, METHOD FOR MANUFACTURING SAME, AND ELECTROPHOTOGRAPHIC APPARATUS USING SAME

CROSS-REFERENCE TO RELATED APPLICATION(S)

This non-provisional Application for a U.S. Patent is the U.S. National Stage of and claims priority from International Application PCT/JP2011/067933 filed Aug. 5, 2011, the entire contents of which is hereby incorporated by reference.

BACKGROUND OF THE INVENTION

1. Field of the Invention

The present invention relates to an electrophotographic photoreceptor (often simply referred to as "photoreceptor" hereinafter), a method for manufacturing the same, and an electrophotographic apparatus using the same. Particularly, the present invention relates to an electrophotographic photoreceptor used in an electrophotographic printer, copier, facsimile machine and the like, a method for manufacturing such an electrophotographic photoreceptor, and an electrophotographic apparatus using the same.

2. Background of the Related Art

Printers, copiers, facsimile machines, and other image forming apparatuses using the electrophotographic system in general have a photoreceptor functioning as an image carrier, a charging device for evenly charging the surface of the photoreceptor, an exposure device that produces an electrical image (electrostatic latent image) corresponding to an image onto the surface of the photoreceptor, a developing device for developing the electrostatic latent image using toner to form a toner image, and a transfer device for transferring this toner image to a transfer sheet. Such image forming apparatuses also have a fixing device for fusing the toner on the transfer sheet to the transfer sheet.

These types of image forming apparatuses use different photoreceptors for different purposes. Recently, in addition to inorganic photoreceptors of Se, a-Si or the like used in large machines or high-speed machines, organic photoreceptors (or OPCs: organic photo conductors) configured by diffusing an organic pigment in resin have widely been used due to their excellent stability, low costs, and ease of use. Generally, while an inorganic photoreceptor is of a positively-charged type, an organic photoreceptor is of a negatively-charged type. This is due to the fact that although a hole transport material with a good hole transportation function has been developed for creating a negatively-charged type organic photoreceptor, an electron transport material with a good electron transportation function cannot easily be develop for a positively-charged type organic photoreceptor.

A problem in a negatively charging process for the negatively-charged type organic photoreceptor is that the fact that the amount of ozone generated by a negative corona discharge is approximately 10 times that generated by a positive corona discharge has a negative impact on the photoreceptor and the environment in which the photoreceptor is used. For this reason, the negatively charging process aims to reduce the amount of the generated ozone by means of a contact charging system in which a roller or a brush is used to charge the photoreceptor. The contact charging system, however, is not only more disadvantageous in terms of cost than a non-contact charging system of the positive polarity, but also lacks credibility due to not being able to prevent contamination by a charging member. Another disadvantage of the contact charging system is that it cannot make the surface potential of the photoreceptor uniform, which leads to poor image quality.

The use of the positively-charged type organic photoreceptor is an effective way to solve these problems; thus, there is demand for a high-performance positively-charged type organic photoreceptor. A positively-charged type organic photoreceptor not only has the benefits specific to the positively charged system described above but also advantages in terms of less lateral diffusion of carriers compared to the negatively-charged photoreceptor and excellent reproducibility of dots (resolution and gradation). The positively-charged organic photoreceptors, therefore, have been studied in a variety of areas producing high-resolution images.

As has previously been proposed, the layer structure of a positively-charged organic photoreceptor is categorized into four structures as described below. The first one is a function-separated photoreceptor composed of two layers in which a charge transport layer and a charge generation layer are sequentially stacked on a conductive support, see Japanese Examined Patent Publication No. H05-30262 (Patent Document 1) and Japanese Patent Application Publication No. H04-242259 (Patent Document 2), for example. The second one is a function-separated photoreceptor composed of three layers in which a surface protective layer is stacked on the two layers described above, see Japanese Examined Patent Publication No. H05-47822 (Patent Document 3), Japanese Examined Patent Publication No. H05-12702 (Patent Document 4), and Japanese Patent Application Publication No. H04-241359 (Patent Document 5), for example. The third one is a function-separated photoreceptor composed of two layers in which a charge generation layer and a charge (electron) transport layer are stacked in the order opposite to that of the first one, see Japanese Patent Application Publication No. H05-45915 (Patent Document 6) and Japanese Patent Application Publication No. H07-160017 (Patent Document 7), for example. The fourth one is a single-layer photoreceptor in which a charge generation material, a hole transport material, and an electron transport material are diffused in one common layer, see Patent Document 6 and Japanese Patent Application Publication No. H03-256050 (Patent Document 8), for example. Note that these four structures do not take into consideration the presence/absence of an undercoating layer.

Of these four structures, the fourth one of the single-layer photoreceptor has been studied in detail and taken into wide practical use. This is mainly because the electron transportation function of the electron transport material is complemented by the hole transport material because the electron transportation function is weaker than the hole transportation function of the hole transport material. Due to the structure of this single-layer photoreceptor in which the materials are diffused in the same layer, carriers occur in the film as well. However, because more carriers are generated in the vicinity of the surface of the photosensitive layer of this photoreceptor and the distance for transporting electrons is shorter than the distance for transporting holes, the electron transportation ability does not have to be as high as the hole transportation ability. For these reasons, the single-layer photoreceptor can attain practically more sufficient environmental stability and fatigue characteristics, compared to the other three structures mentioned above.

Nevertheless, while the capability of the single film of the single-layer photoreceptor for generating and transporting carriers enables a simple coating process and realizes high efficiency percentage and process capability, incorporating the hole transport material and the electron transport material in large amounts in the single layer to achieve high sensitivity ends up reducing the amount of binder resin contained therein, deteriorating the durability of the photoreceptor. Thus, there is a limit on making the single-layer photoreceptor both highly sensitive and highly durable.

The lowered ratio of the binder resin in the single-layer photoreceptor leads to a lowering of the glass transition point and consequently a worsening of contamination resistance of the single-layer photoreceptor to a contact member. In addition, as described in Japanese Patent Application Publication No. 2007-163523 (Patent Document 9), Japanese Patent Application Publication No. 2007-256768 (Patent Document 10), and Japanese Patent Application Publication No. 2007-121733 (Patent Document 11), further reduction of the glass transition point occurs when a phenylene compound is added as a plasticizer to the photosensitive layer of the single-layer photoreceptor in order to prevent the photoreceptor from being contaminated by grease or sebum. This is a factor of a significant creep deformation in an apparatus in which a roller or the like comes into contact with its organic photoreceptor at high contact pressure, resulting in obvious print defects.

Therefore, the conventional single-layered positively-charged organic photoreceptor is not sufficiently capable of providing sensitivity, durability and contamination resistance in order to deal with reduced size, increased speed and resolution, and colorization of recent apparatuses. Thus, new layered positively-charged photoreceptors having a charge transport layer and charge generation layer stacked sequentially therein have been proposed, see Japanese Patent Application Publication No. 2009-288569 (Patent Document 12) and WO 2009/104571 (Patent Document 13), for example. Similarly to the first layer structure described previously, in each of the layer structures of these layered positively-charged photoreceptors, an electron transport material and a small amount of charge generation material are incorporated in the charge generation layer to make the charge generation layer as thick as the charge transport layer therebelow. In addition, only a small amount of hole transport material is contained in the charge generation layer, so that the ratio of resin in the charge generation layer can be set higher than that of the conventional single-layer photoreceptor. In this manner, the highly sensitive and highly durable layered positively-charged photoreceptors can be realized.

These layered positively-charged organic photoreceptors are mass-produced by means of a dip coating method, as with the single-layer photoreceptor. Therefore, when dip-coating the charge generation layer on the charge transport layer, it is important to make sure that the solubility, dispersibility and dispersion stability of a material in the charge generation layer are good, and a solvent that does not easily elute a material of the charge transport layer needs to be selected as a solvent of a charge generation layer coating liquid. Such a solvent preferably has a high boiling point in general. Specifically, the high boiling point is preferably 60° C. or higher and particularly 80° C. or higher. When titanyl phthalocyanine with high quantum efficiency needs to be used for the charge generation material in order to increase the sensitivity, it is preferred to employ heavy dichloroethane having a boiling point of 80° C. or higher. As the improvement regarding the solvent, Japanese Patent Application Publication No. H9-43887 (Patent Document 14), for example, discloses technology pertaining to a photoreceptor in which the amount of residual solvent in a photosensitive layer thereof is within a predetermined range.

Although the layered positively-charged organic photoreceptors disclosed in Patent Documents 12 and 13 are highly sensitive, highly durable, and resistant to contamination by grease, these photoreceptors are not resistant to contamination by human sebum and therefore easily generate cracks.

An object of the present invention, therefore, is to provide a highly sensitive and highly durable electrophotographic photoreceptor, a method for manufacturing the same, and an electrophotographic apparatus using the same, the photoreceptor being applicable to a high-resolution and high-speed positively-charged electrophotographic apparatus, being excellent in operational stability, providing no image defects that are the results of cracks generated due to image memories or contamination by contact members, grease, or sebum, and being capable of stably providing high image qualities.

SUMMARY OF THE INVENTION

As a result of closely studying how cracks are formed by sebum, the inventors of the present invention have discovered that the amount of residual solvents and the amount of charge transport material are heavily involved in the formation of cracks in the layered positively-charged organic photoreceptors that can be configured by a smaller amount of charge transport material and a larger proportion of binder resin, compared to a single-layer organic photoreceptor, the charge transport material and the binder resin being contained in the surface layer of the photoreceptor.

FIG. 3 is a graph showing the relationship between a time period for which a layered positively-charged electrophotographic photoreceptor is left at room temperature, and the amount of residual solvent therein, the layered positively-charged electrophotographic organic photoreceptor being obtained after drying a charge generation layer therefore at 90° C. for one hour. FIG. 4 is a graph showing a crack incidence rate obtained after adhering sebum to a surface of the layered positively-charged electrophotographic organic photoreceptor for 10 days. In most cases the color of the sebum adhered to the parts with cracks is changed. Based on this fact, it is considered that the charge transport material dissolved by oil of the sebum can move easily towards the sebum. In other words, the following mechanism is considered.

To be specific, when there remains a solvent in a film of the photosensitive layer, the charge transport material is dissolved by the oil exposed from the sebum and moves easily to the sebum adhered to the film surface. Such movement of the charge transport material increases the voids in the film. Consequently, stress is concentrated on these enlarged voids, thereby creating cracks in the film. The residual solvent seems to be largely involved in this series of phenomena.

It is considered that the amount of residual solvent in the photosensitive layer can effectively be reduced by carrying out a drying step of drying the film at high temperature or increasing the processing time when manufacturing the photoreceptor. This method, however, not only easily leads to deterioration of the functional materials of the film due the heat, but also worsens the electrical properties of the photoreceptor, i.e., the sensitivity characteristics and residual potential characteristics of the photoreceptor, and hence the performance of the photoreceptor.

As a result of further investigation in view of these facts, the inventors have discovered that drying the film under reduced pressure is an effective way to reduce the amount of residual solvent at as low temperature as possible and within a short period of time without impeding the productivity. The inventors consequently have conceived the present invention based on their findings that a highly durable, layered positively-charge organic photoreceptor that is excellent in sensitivity and contamination resistance can stably be produced without impeding the electrical properties thereof or forming cracks even when sebum is adhered thereto.

Specifically, the electrophotographic photoreceptor of the present invention is a layered positively-charged electrophotographic photoreceptor which is configured by sequentially stacking, on a conductive support, a charge transport layer containing at least a hole transport material and binder resin and a charge generation layer containing at least a charge generation material, a hole transport material, an electron transport material, and binder resin, wherein a total amount of residual solvents contained in the charge generation layer and the charge transport layer is 50 $\mu g/cm^2$ or less.

In the present invention, it is preferred that the hole transport material and the binder resin of the charge transport layer be contained in the charge generation layer as well. It is also preferred that the charge generation material contain titanyl phthalocyanine and that a solvent used for forming the charge generation layer be dichloroethane. A total moisture content of the charge generation layer and the charge transport layer is preferably within a range of 0.05 to 1.5% by mass.

A method for manufacturing an electrophotographic photoreceptor according to the present invention includes sequentially forming the charge transport layer and the charge generation layer on the conductive support by means of a dip coating method, and thereafter drying, under reduced pressure, the charge transport layer and the charge generation layer that have been formed.

An electrophotographic apparatus of the present invention is equipped with the electrophotographic photoreceptor of the present invention.

With the configurations described above, the present invention can provide a highly sensitive and highly durable electrophotographic photoreceptor, a method for manufacturing the same, and an electrophotographic apparatus using the same, the photoreceptor being applicable to a high-resolution and high-speed positively-charged electrophotographic apparatus, being excellent in operational stability, providing no image defects that are the results of cracks generated due to image memories or contamination by contact members, grease, or sebum, and being capable of stably providing high image qualities.

DETAILED DESCRIPTION OF THE INVENTION

Embodiments of the present invention are now described hereinafter in detail with reference to the drawings. However, the present invention is not at all limited by the following descriptions.

Figure 1:
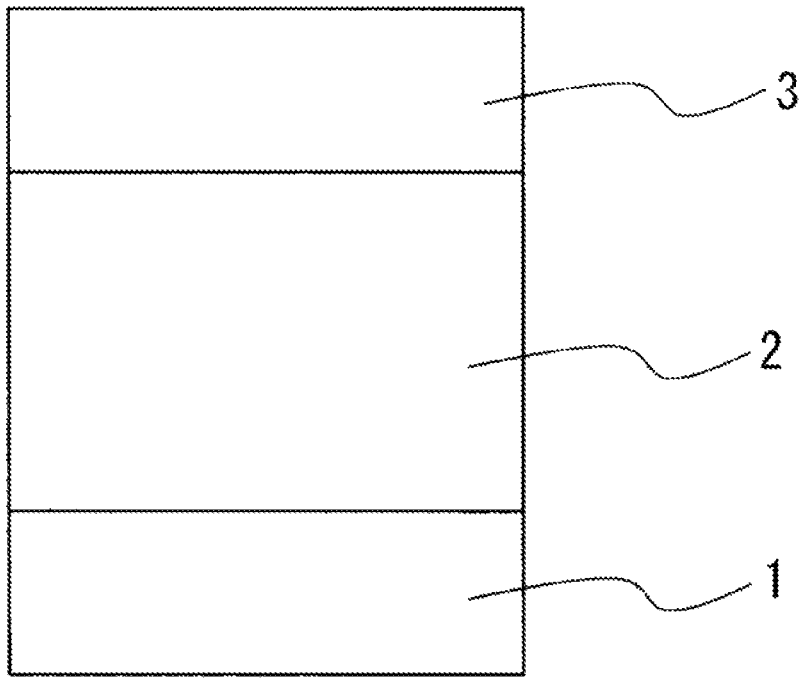
FIG. 1 is a schematic cross-sectional diagram showing a configuration example of a layered positively-charged electrophotographic photoreceptor according to the present invention.
Figure 2:
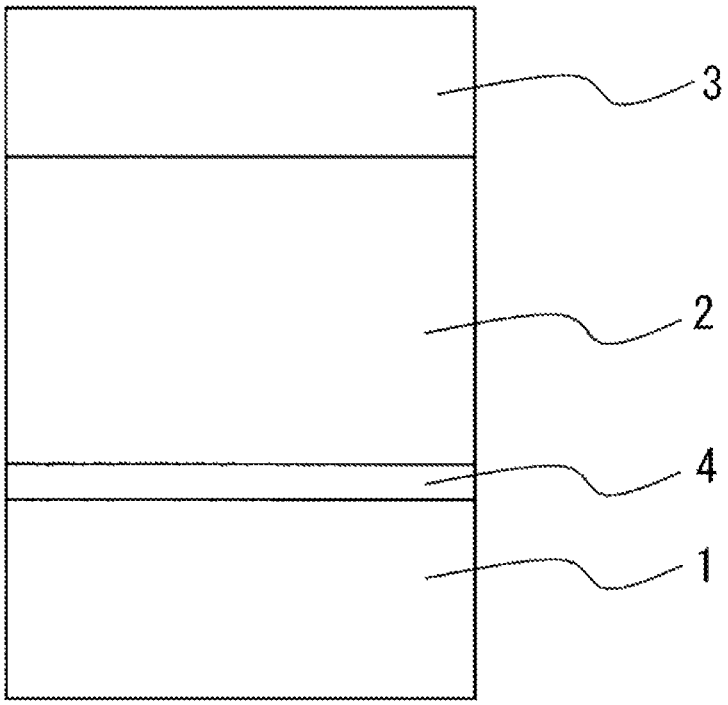
FIG. 2 is a schematic cross-sectional diagram showing another configuration example of the layered positively-charged electrophotographic photoreceptor according to the present invention.
Figure 3:
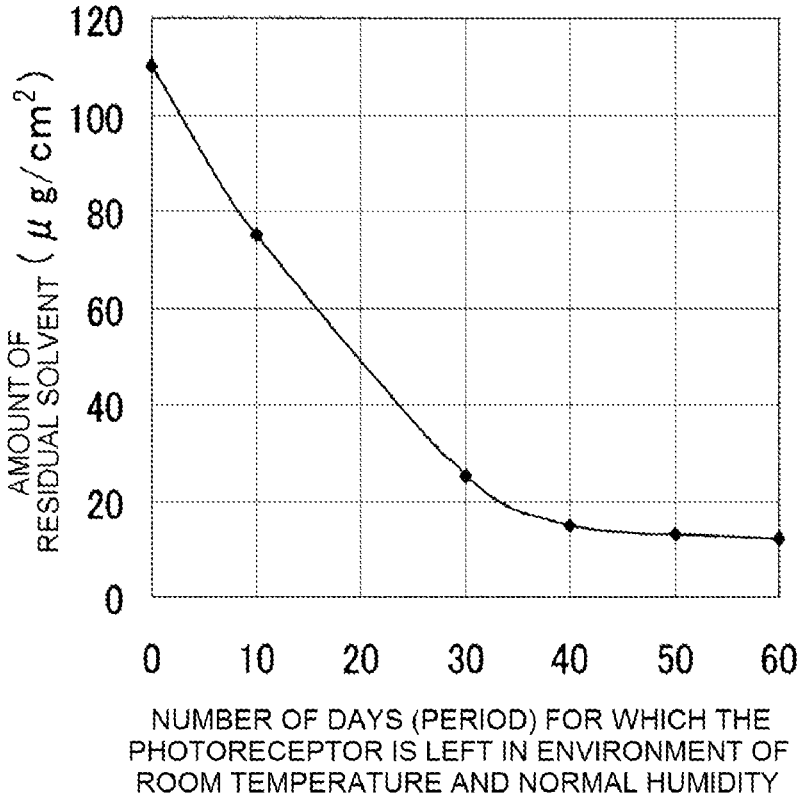
FIG. 3 is a graph showing the relationship between a time period for which a layered positively-charged electrophotographic photoreceptor is left at room temperature, and the amount of residual solvent therein.
Figure 4:
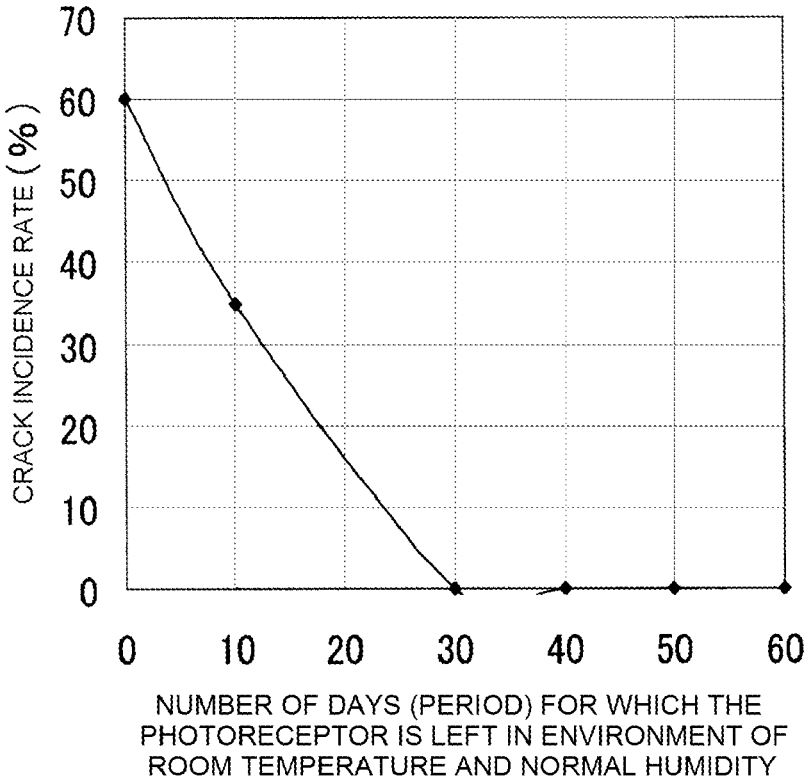
FIG. 4 is a graph showing a crack incidence rate obtained after adhering sebum to a surface of the layered positively-charged electrophotographic photoreceptor for 10 days.

FIGS. 1 and 2 are schematic cross-sectional diagrams each showing a configuration example of a layered positively-charged electrophotographic photoreceptor according to the present invention. As shown in FIG. 1, the electrophotographic photoreceptor of the present invention is a positively-charged, layered electrophotographic photoreceptor configured by sequentially stacking at least a charge transport layer 2 and a charge generation layer 3 on a conductive support 1. The electrophotographic photoreceptor of the present invention may also include an undercoating layer 4 for the purpose of preventing interference fringes, as shown in FIG. 2.

In the present invention, while the charge transport layer 2 includes at least a hole transport material and binder resin, the charge generation layer 3 includes at least a charge generation material, a hole transport material, a charge transport material, and binder resin. The key point in this configuration is that the total amount of residual solvents contained in the charge generation layer 3 and the charge transport layer 2 is 50 $\mu g/cm^2$ or less. Although it is critical to control the amount of residual solvents and the amount of charge transport material in order to protect the electrophotographic photoreceptor from cracks and other contamination by sebum as described above, the amount of charge transport material affects the basic properties of the photoreceptor and therefore cannot be adjusted alone. The present invention, therefore, aims to improve the photoreceptor's resistance to contamination by sebum by reducing the amount of residual solvents to the range described above. The total amount of residual solvents needs to be 50 $\mu g/cm^2$ or less, and preferably 25 $\mu g/cm^2$ or less.

In the present invention, the total amount of residual solvents contained in the charge generation layer and the charge transport layer may be any value as long as the conditions described above are satisfied, so that a desired effect of the present invention can be attained. In the present invention, the conditions for specific configurations of other layers can appropriately be determined in accordance with a request and are not to be particularly limited.

Conductive Support

The conductive support 1 functions not only as an electrode of the photoreceptor but also as a support of each of the layers configuring the photoreceptor. The conductive support 1 may be in the shape of a cylinder, a plate, or a film, and the material thereof may be metal such as aluminum, stainless steel or nickel, or may be glass or resin subjected to a conductive treatment on the surface thereof.

Undercoating Layer

The undercoating layer 4 is basically not required in the present invention but can be provided if necessary. The undercoating layer 4 is formed from a layer having resin as a principal component or a metal oxide film made of anodized aluminum. The undercoating layer 4 is provided for the purpose of improving the adhesion between the conductive support and the charge transport layer or controlling injection of charges into a photosensitive layer. Examples of the resin material used in the undercoating layer include insulating polymers such as casein, polyvinyl alcohol, polyamide, melamine, and cellulose, as well as conductive polymers such as polythiophene, polypyrrole, and polyaniline. These resins can be used alone or in an appropriate combination or mixture. These resins can contain metallic oxide such as titanium dioxide or zinc oxide.

Charge Transport Layer

The charge transport layer 2 is configured mainly by a hole transport material and binder resin.

Hole Transport Material

As the hole transport material used in the charge transport layer 2, various hydrazone compounds, styryl compounds, diamine compounds, butadiene compounds, indole compounds and the like can be used alone or in an appropriate combination. Above all, a styryl-based compound with triphenylamine skeleton is preferred in terms of cost and performance. Note that the charge transport layer 2 is located on the inside of the charge generation layer 3 and therefore protected from contamination by members, i.e., the impact of contact pressure from a transfer roller or a developing roller. Thus, unlike in the case of a single-layer organic photoreceptor, the charge transport layer 2 can employ low-molecular-weight triphenylamine as a plasticizer for the purpose of crack prevention and offsetting the side effects.

Binder Resin

As the binder resin of the charge transport layer 2, polycarbonate resin such as bisphenol A type, bisphenol Z type, or bisphenol A type-biphenyl copolymer, polyester resin, polystyrene resin, polyphenylene resin and the like can be used alone or in an appropriate combination. Above all, as will be described hereinafter, the binder resin of the charge transport layer 2 is preferably the same as that of the charge generation layer 3, and as the binder resin, resin having a molecular weight of 30,000 or more is preferred in terms of its indissolubility, and polycarbonate resin having a molecular weight of 50,000 or more is the most appropriate.

Solvent

Examples of the solvent of the charge transport layer include halogenated hydrocarbon such as dichloromethane, dichloroethane, chloroform, carbon tetrachloride, and chlorobenzene; ethers such as dimethyl ether, diethyl ether, tetrahydrofuran, dioxane, dioxolane, ethylene glycol dimethyl ether, and diethylene glycol dimethyl ether; and ketones such as acetone, methyl ethyl ketone, and cyclohexanone. The solvent used in the charge transport layer is selected in consideration of the solubility, coating properties, and storage stability of the hole transport material or the binder resin.

Composition

The mass ratio between the hole transport material and the binder resin in the charge transport layer 2 can be 1:3 to 3:1 (25:75 to 75:25) but is preferably 1:1.5 to 1.5:1 (40:60 to 60:40). A content of less than 25% by mass of the hole transport material in the charge transport layer 2 generally results in low transferability, high residual potential, and high dependence of the potential of an exposure part of an apparatus on the environment, worsening the environmental stability of image quality. Such a hole transport material might not be usable. However, when the content of the hole transport material in the charge transport layer 2 is greater than 75% by mass and therefore the content of the binder resin in the charge transport layer 2 is less than 25% by mass, elution of these materials from the charge transport layer 2 causes a harmful effect when applying the charge generation layer 3.

Film Thickness

The film thickness of the charge transport layer 2 is determined with the charge generation layer 3 in mind. In view of ensuring practically effective performance of the charge transport layer 2, the film thickness thereof is preferably 3 μm to 40 μm, more preferably 5 μm to 30 μm, and yet more preferably 10 μm to 20 μm.

Charge Generation Layer

As described earlier, the charge generation layer 3 is formed by using a method of applying coating liquid that is obtained by diffusing the particles of the charge generation material in the binder resin having the hole transport material and electron transport material dissolved therein. The charge generation layer 3 functions not only to accept light to generate carriers but also to transport the generated electrons to the surface of the photoreceptor and transport holes to the charge transport layer 2. It is important that the charge generation layer 3 generates carriers with a high degree of efficiency and injects the generated holes into the charge transport layer 2 efficiently, and it is preferred that the charge generation layer 3 have low electric field dependence and inject the holes even in a low electric field.

Charge Generation Material

As the charge generation material, X-type metal-free phthalocyanine can be used alone, but α-type titanyl phthalocyanine, β-type titanyl phthalocyanine, Y-type titanyl phthalocyanine, γ-type titanyl phthalocyanine, and amorphous-type titanyl phthalocyanine can also be used alone or in an appropriate combination. A favorable material can be selected depending on an optical wavelength region of an exposure light source used in image formation. Titanyl phthalocyanine with high quantum efficiency is the most appropriate in terms of improving the sensitivity of the photoreceptor.

When using titanyl phthalocyanine as the charge generation material, it is preferred that the total moisture content in the charge generation layer 3 and the charge transport layer 2 be 0.05 to 1.5% by mass and particularly 0.1 to 1.0% by mass. Increasing the moisture contents can improve the sensitivity when using titanyl phthalocyanine, and can particularly facilitate ensuring a print density in a low temperature/humidity environment. However, excessive moisture contents are likely to lower the electrification characteristics of the layers especially in a hot and humid environment, and, depending on an apparatus to install the photoreceptor, results in lowering of the charge acceptance and resolution.

Charge Transport Material (Hole Transport Material)

The difference in ionization potential between the hole transport material and the charge transport material of the charge transport layer is preferably as low as 0.5 ev or less in view of the necessity to inject holes into the charge transport layer. Particularly, in the present invention, because the charge generation layer 3 is applied and formed on the charge transport layer 2, it is preferred that the hole transport material contained in the charge transport layer 2 be included in the charge generation layer 3 as well, so as to stabilize the liquid state of the charge generation layer 3 while minimizing the impact of elution of the material from the charge transport layer 2 into the coating liquid of the charge generation layer 3. It is further preferred that the hole transport material contained in the charge generation layer 3 be the same as that of the charge transport layer 2.

Charge Transport Material (Electron Transport Material)

The higher the mobility of an electron transport material is, the better. Preferred examples of the electron transport material include quinones such as benzoquinone, stilbenequinone, naphthoquinone, diphenoquinone, phenanthrenequinone, and azoquinone. For the purpose of being injected into the charge transport layer efficiently and obtaining compatibility with the binder resin, these materials may be used alone, but it is preferred that two or more of these materials be used to increase the content of the electron transport material while inhibiting precipitation of the materials.

Binder Resin

As the binder resin used in the charge generation layer, polycarbonate resin such as bisphenol A type, bisphenol Z type, or bisphenol A type-biphenyl copolymer, polyester resin, polystyrene resin, polyphenylene resin and the like can be used alone or in an appropriate combination. Above all, polycarbonate resin is preferred in terms of stably diffusing the charge generation material, the compatibility with the hole transport material and the electron transport material, mechanical stability, chemical stability, and thermal stability. In particular, as with the hole transport material, it is preferred that the binder resin contained in the charge transport layer 2 be included in the charge generation layer 3 as well, so as to stabilize the liquid state of the charge generation layer 3 while minimizing the impact of elution of the binder resin from the charge transport layer 2 into the coating liquid of the charge generation layer 3. It is further preferred that the binder resin contained in the charge generation layer 3 be the same as that of the charge transport layer 2.

Solvent

Examples of the solvent of the charge generation layer include halogenated hydrocarbon such as dichloromethane, dichloroethane, chloroform, carbon tetrachloride, and chlorobenzene; ethers such as dimethyl ether, diethyl ether, tetrahydrofuran, dioxane, dioxolane, ethylene glycol dimethyl ether, and diethylene glycol dimethyl ether; and ketones such as acetone, methyl ethyl ketone, and cyclohexanone. It is preferred that the solvent of the charge generation layer have a high boiling point of 60° C. or higher. In particular, a solvent having a boiling point of 80° C. or higher is preferably used. When titanyl phthalocyanine with high quantum efficiency is used in the charge generation material in order to improve the sensitivity of the photoreceptor, heavy dichloroethane having a boiling point of 80° C. or higher is preferably used as the solvent for forming the charge generation layer, in terms of its stable diffusion and indissolubility in the charge transport layer.

Composition

The amount of distribution of each of the functional materials in the charge generation layer 3 (the charge generation material, the electron transport material, and the hole transport material) is set as follows. First of all, in the present invention, it is preferred that the content of the charge generation material in the charge generation layer 3 be 1 to 2.5% by mass and particularly 1.3 to 2.0% by mass. The mass ratio between the sum of the contents of the functional materials in the charge generation layer 3 (the charge generation material, the electron transport material, and the hole transport material) and the binder resin is set at 35:65 to 65:35 to obtain the desired characteristics. However, in terms of preventing contamination by members, contamination by grease, and contamination by sebum while ensuring the durability of the photoreceptor, it is preferred that the mass ratio be set at 50 or less: 50 or more to have a higher amount of the binder resin.

When the mass ratio of the functional materials in the charge generation layer 3 is greater than 65% by mass and therefore the amount of binder resin in the same is less than 35% by mass, significant film thinning occurs, resulting in lowering of the durability and the glass transition point and consequently reduction of the creep strength, as well as the occurrence of toner filming and filming of an external additive or paper powder. Moreover, contamination by a contact member (creep deformation) occurs easily, and then contamination by grease and sebum worsens. When the mass ratio of the functional materials in the charge generation layer 3 is less than 35% by mass and therefore the amount of binder resin in the same is greater than 65% by mass, it becomes difficult to achieve the desired sensitivity characteristics, in which case the charge generation layer 3 might not be practical.

The mass ratio between the electron transport material and the hole transport material can vary between 1:5 to 5:1. In the present invention, however, due to the presence of the charge transport layer 2 with a hole transportation function under the charge generation layer 3, the mass ratio is preferably 5:1 to 4:2, and more preferably 4:1 to 3:2 in terms of obtaining comprehensive characteristics of both materials, unlike the composition in a single-layer organic photoreceptor that is rich in hole transport material that provides the general mass ratio of 1:5 to 2:4. In the layered photoreceptor according to the present invention, a large amount of hole transport material can be mixed in the charge transport layer 2 disposed under the charge generation layer 3. Thus, unlike a single-layer photoreceptor, the content of the hole transport material which can generate cracks when sebum is adhered thereto, can be kept low in the charge generation layer 3 disposed above the charge transport layer 2.

Other Additives

In the present invention, if desired, the charge generation layer and the charge transport layer can contain a deterioration inhibitor such as an antioxidant or a photostabilizer, for the purpose of improving the environmental resistance of these layers and the stability of the same against harmful light. Examples of the compound that can be used for this purpose include chromanol derivatives such as tocopherol, esterified compounds, polyarylalkane compounds, hydroquinone derivatives, etherified compounds, dietherified compounds, benzophenone derivatives, benzotriazole derivatives, thioether compounds, phenylenediamine derivatives, phosphonic ester, phosphite, phenol compounds, hindered phenol compounds, straight-chain amine compounds, cyclic amine compounds, and hindered amine compounds.

The charge generation layer and the charge transport layer may also contain a leveling agent such as silicone oil and fluorine-based oil, for the purpose of improving the leveling properties of the formed films and providing lubricity to the films. In addition, for the purpose of adjusting the hardness of the films, reducing the frictional coefficients, and applying lubricity to the films, the charge generation layer and the charge transport layer can contain the following additives: metallic oxides such as silicon oxide (silica), titanium oxide, zinc oxide, calcium oxide, aluminum oxide (alumina), and zirconium oxide, metal sulfates such as barium sulfate and calcium sulfate, fine particles of metallic nitrides such as silicon nitride and aluminum nitride, particles of fluorine-based resins such as polytetrafluoroethylene, and fluorine-based comb-like graft polymerized resin. Further, if necessary, other known additives may be contained in the charge generation layer and the charge transport layer without significantly impeding the electrophotographic characteristics thereof.

Film Thickness

The film thickness of the charge generation layer 3 is determined with the charge transport layer 2 in mind. In view of ensuring practically effective performance of the charge generation layer 3, the film thickness thereof is preferably 3 μm to 40 μm, more preferably 5 μm to 30 μm, and yet more preferably 10 μm to 20 μm.

The photoreceptor of the present invention can be produced by successively forming the charge transport layer 2 and the charge generation layer 3 on the conductive support 1 by means of a dip coating method in the usual manner and thereafter drying the formed charge transport layer 2 and charge generation layer 3 under reduced pressure. Specifically, first, the charge transport layer 2 is formed on the conductive support 1 by means of a dip coating method in the usual manner, and then the formed charge transport layer 2 is hot-air dried. Subsequently, the charge generation layer 3 is formed on the formed charge transport layer 2 by means of a dip coating method in the usual manner, and then the formed charge generation layer 3 is hot-air dried. After the formation of these layers, these layers are normally hot-air dried at 90 to 120° C. in such a manner as to not impede the performances of the functional materials contained therein. Next, the formed charge transport layer 2 and charge generation layer 3 are further dried under reduced pressure to effectively reduce the amount of solvents remaining in the charge transport layer 2 and the charge generation layer 3. In this manner, the photoreceptor of the present invention that is excellent in contamination resistance can be produced easily in a massive scale without deteriorating the electrical properties thereof.

According to the present invention, drying under reduced pressure can be performed at, for example, a vacuum degree of 500 Pa or lower or particularly 100 Pa or lower, using hot air of approximately 80 to 100° C. for 30 to 60 minutes. When the reduced pressure is insufficient, the temperature is too low, or the drying time is too short, the amount of residual solvents cannot be reduced adequately, and sufficient contamination resistance cannot be obtained. Excessively high temperature or excessively short drying time can result in impeding the electrical properties of the photoreceptor.

Because this step of drying under reduced pressure can also reduce the moisture contents of the charge transport layer 2 and the charge generation layer 3, it is preferred in the present invention that, after the step of drying under reduced pressure, the photoreceptor be put under high temperature and humidity conditions for a predetermined period of time. In this manner, the moisture contents of the charge transport layer 2 and the charge generation layer 3 can be adjusted to the preferred range mentioned above.

Electrophotographic Apparatus

The desired effects can be obtained by applying the electrophotographic photoreceptor of the present invention to various machine processes. Specifically, adequate effects can be attained even in a system with or without a paper powder removal process using a sponge roller, a brush or the like, and the development processes such as a contact development system and non-contact development system using a non-magnetic single-component development system, a magnetic single-component development system, and a magnetic two-component development system.

Figure 5:
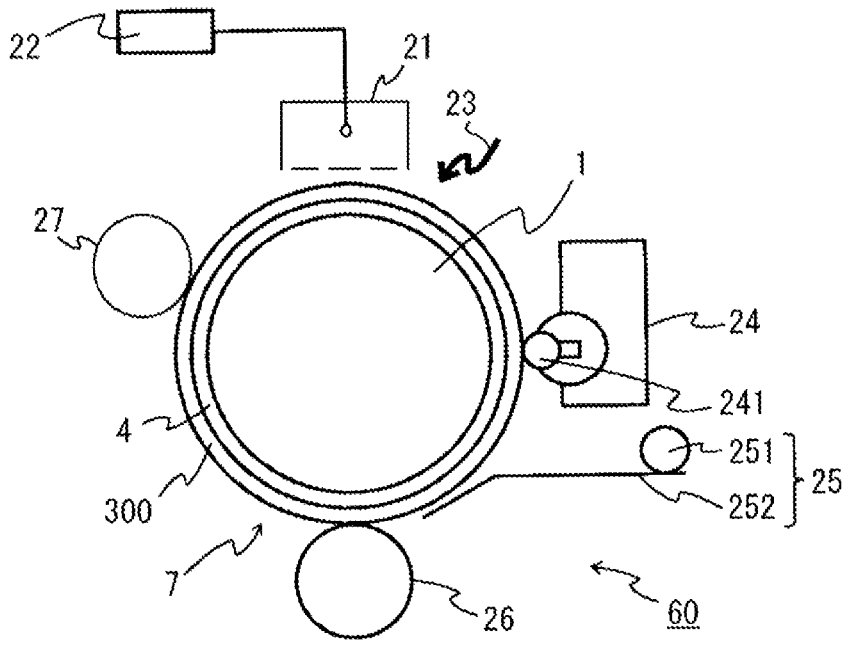
FIG. 5 is a schematic configuration diagram showing a configuration example of an electrophotographic apparatus according to the present invention.

FIG. 5, for instance, is a schematic configuration diagram showing a configuration example of the electrophotographic apparatus of the present invention. An electrophotographic apparatus 60 of the present invention is equipped with an electrophotographic photoreceptor 7 of the present invention that has the conductive support 1, the undercoating layer 4 placed on an outer circumferential surface thereof, and a photosensitive layer 300. The electrophotographic apparatus 60 is also configured by a charger (scorotron) 21 disposed at an outer rim portion of the photoreceptor 7, a high voltage power supply 22 for supplying applied voltage to the scorotron 21, an image exposure member 23, a developer 24 having a developing roller 241, a sheet feeding member 25 having a feed roller 251 and a feed guide 252, a transfer electrode (transfer roller) 26, and a paper powder removing member (paper powder removing sponge roller) 27. The electrophotographic apparatus 60 of the present invention can be a color printer.

EXAMPLES

Specific aspects of the present invention are described hereinafter in further detail by using examples. The present invention is not limited to the following examples unless the examples depart from the gist of the present invention.

Example of Producing Electrophotographic Photoreceptor

Example 1

A 0.75 mm-thick aluminum tube having 30 mm in diameter and 244.5 mm in length and machined to have a surface roughness (Rmax) of 0.2 μm was used as the conductive support.

Production of Charge Transport Layer Coating Liquid

A styryl compound (CTM-A) shown in the following Structural Formula 1 in an amount of 100 parts by mass was prepared as the hole transport material, and 100 parts by mass of polycarbonate resin (TS2050, manufactured by TEIJIN LIMITED) (CTB-A) with a recurring unit shown in the following Structural Formula 2 was prepared as the binder resin. Then, these compounds were dissolved in a tetrahydrofuran solvent to produce charge transport layer coating liquid.

Structural Formula 1 (CTM-A)

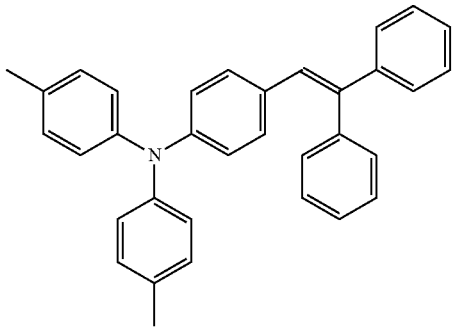

Structural Formula 2 (CTB-A)

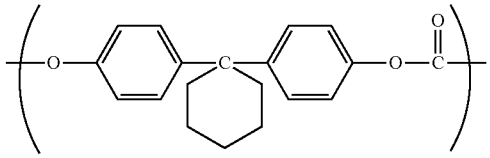

BisZ(PcZ)

Production of Charge Generation Layer Coating Liquid

With respect to 100 parts by mass of polycarbonate resin (CTB-A) same as the one prepared as the binder resin for the charge transport layer, 3 parts by mass of Y-type titanyl phthalocyanine shown in the following Structural Formula 3 as the charge generation material, 11 parts by mass of the compound (CTM-A) same as the one prepared as the hole transport material for the charge transport layer, and 44 parts by mass of a compound (ETM-A) shown in the following Structural Formula 4 as the charge transport material, were mixed in 1,2-dichloroethane and diffused therein using a DYNO-MILL (MULTILAB, manufactured by Shinmaru Enterprises Corporation), to obtain charge generation layer coating liquid.

Structural Formula 3

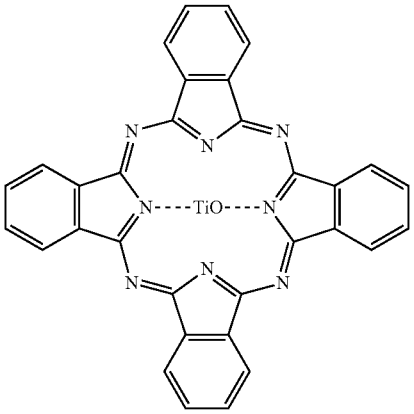

(CGM-A)

Structural Formula 4

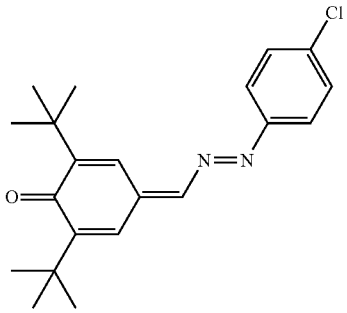

(ETM-A)

Production of the Photoreceptor

The charge transport layer coating liquid prepared as described above was applied onto the conductive support by means of a dip coating method and dried in a drying furnace at 110° C. for one hour, to form a 15 μm-thick charge transport layer. Next, the charge generation layer coating liquid prepared as described above was applied onto this charge transport layer by means of a dip coating method and dried at 115° C. for one hour, to form a 15 μm-thick charge generation layer. As a result, a photoreceptor was obtained.

The amount of residual solvents and the moisture contents in these films of the obtained photoreceptor were measured by gas chromatograph analysis and Karl Fischer analysis, respectively, under the following conditions. As a result, the total amount of residual solvents in the charge generation layer and the charge transport layer was 24 μg/cm$^2$, and the total moisture content was 0.10%. Note that the same measurement method was used throughout the examples described hereinafter.

Measurement of the Amount of Residual Solvents i) Thermal Desorption

Thermal desorption device used: Curie-point pyrolyzer (HS-100A), manufactured by Japan Analytical Industry Co., Ltd. Trap temperature: Heating at 150° C. for 20 minutes→−50° C. cold trap ii) Gas Chromatograph Analysis (GC-MS) Measurement GC-MS measurement device: GC-MS QP5000, manufactured by Shimadzu Corporation. Temperature at inlet: 280° C. Split: 1/10. Column: Capillary Column DB-5 (slightly polar) ϕ0.25×30 m, manufactured by J&W Scientific, Inc. Column temperature: 40° C. (held for 3 minutes)→280° C. (10° C./min)→held at 280° C. for 3 minutes (measurement time: 30 minutes). Carrier gas: Helium, 1 mL/min Measurement of Moisture Contents Karl Fischer (KF) moisture-content measuring device: KF-100, manufactured by Mitsubishi Chemical Corporation. Titration mode: Volume titration method. KF reagent: Aquamicron SS (Mitsubishi Chemical Corporation). Dehydration solvent: Aquamicron PE (Mitsubishi Chemical Corporation).

Sample preparation: An OPC drum cut piece was put in a 50-cc screw tube and dissolved in dichloromethane (DCM) in an amount of approximately 35 g, to obtain a KF analytical sample.

Calculation method: Moisture content of the DCM and moisture content of a photosensitive film peeling element tube were subtracted from the measured value of moisture content of the analytical sample, to calculate the moisture contents of the films based on the following formula. The weights of the films are equivalent to the amount dissolved in the DCM.

"Formula for calculating the moisture contents in the films": (Moisture content in the OPC drum solution×OPC drum weight−moisture content of the solution in the element tube×weight of the element tube−moisture content of the DCM×amount of DCM)/weights of the films

Example 2

A charge generation layer was formed in the same manner as in Example 1, except that the coated charge generation layer was dried at 100° C. for one hour. After the formation of the charge generation layer, the charge generation layer was dried in a vacuum drying furnace at a pressure of 200 Pa and a temperature of 100° C. for 30 minutes, to obtain a photoreceptor of Example 2. In this photoreceptor, the total amount of residual solvents contained in the charge generation layer and the charge transport layer was 25 μg/cm$^2$, and the total moisture content of the films was 0.05%.

Example 3

The photoreceptor of Example 2 was left in a hot and humid environment of 60° C. and 90% RH for four hours, to obtain a photoreceptor of Example 3. In this photoreceptor, the total amount of residual solvents contained in the charge generation layer and the charge transport layer was the same as that of the photoreceptor of Example 2, but the total moisture content of the films was 0.33%.

Example 4

The photoreceptor of Example 2 was left in a hot and humid environment of 70° C. and 90% RH for 24 hours, to obtain a photoreceptor of Example 4. In this photoreceptor, the total amount of residual solvents contained in the charge generation layer and the charge transport layer was the same as that of the photoreceptor of Example 2, but the total moisture content of the films was 1.45%.

Example 5

A photoreceptor was produced in the same manner as in Example 3, except that the total amount of residual solvents was adjusted to 15 μg/cm$^2$ by changing the conditions for drying the films in a vacuum dry furnace. The total moisture content of the films was 0.42%.

Example 6

A photoreceptor was produced in the same manner as in Example 3, except that the total amount of residual solvents was adjusted to 5 μg/cm$^2$ by changing the conditions for drying the films in the vacuum dry furnace. The total moisture content of the films was 0.56%.

Example 7

A photoreceptor was produced in the same manner as in Example 1, except that the ratio between the electron transport material and the hole transport material in the charge generation layer was set at 3:1 (41.25 parts by mass: 13.75 parts by mass).

Example 8

A photoreceptor was produced in the same manner as in Example 1, except that the ratio between the electron transport material and the hole transport material in the charge generation layer was set at 2:3 (22 parts by mass: 33 parts by mass).

Example 9

A photoreceptor was produced in the same manner as in Example 1, except that a compound (CTM-B) shown in the following Structural Formula 5 was used as the hole transport material for the charge generation layer and the charge transport layer, in place of the compound (CTM-A).

Structural Formula 5

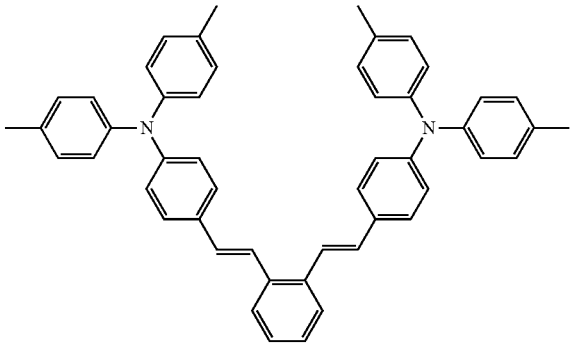

(CTM-B)

Example 10

A photoreceptor was produced in the same manner as in Example 8, except that the compound (CTM-B) shown in the Structural Formula 5 was used as the hole transport material for the charge generation layer and the charge transport layer, in place of the compound (CTM-A).

Example 11

A photoreceptor was produced in the same manner as in Example 1, except that a compound (CTM-C) shown in the following Structural Formula 6 was used as the hole transport material for the charge generation layer and the charge transport layer, in place of the compound (CTM-A).

Structural Formula 6

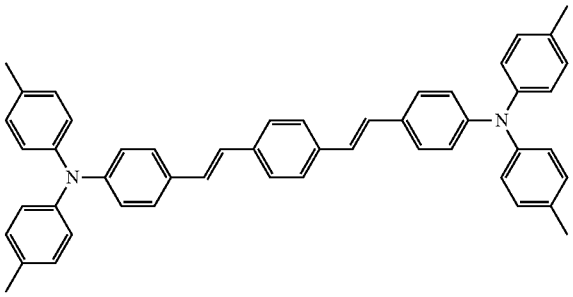

(CTM-C)

Example 12

A photoreceptor was produced in the same manner as in Example 8, except that the compound (CTM-C) shown in the Structural Formula 6 was used as the hole transport material for the charge generation layer and the charge transport layer, in place of the compound (CTM-A).

Example 13

A photoreceptor was produced in the same manner as in Example 1, except that 10% by mass of the compound (CTM-A) was substituted with a compound (CTM-D) shown in the following Structural Formula 7 to obtain the hole transport material for the charge generation layer and the charge transport layer.

Structural Formula 7

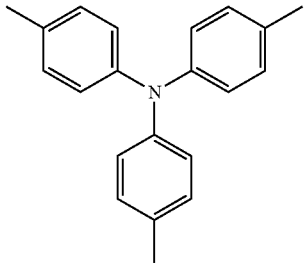

(CTM-D)

Example 14

A photoreceptor was produced in the same manner as in Example 8, except that 10% by mass of the compound (CTM-A) was substituted with the compound (CTM-D) shown in the Structural Formula 7 to obtain the hole transport material for the charge generation layer and the charge transport layer.

Example 15

A photoreceptor was produced in the same manner as in Example 1, except that a compound (ETM-B) shown in the following Structural Formula 8 was used as the electron transport material of the charge generation layer, in place of the compound (ETM-A).

Structural Formula 8

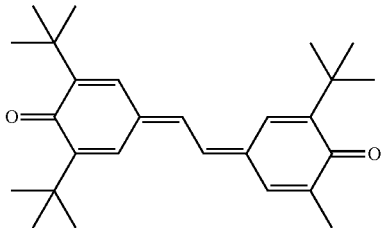

(ETM-B)

Example 16

A photoreceptor was produced in the same manner as in Example 8, except that the compound (ETM-B) shown in the Structural Formula 8 was used as the electron transport material of the charge generation layer, in place of the compound (ETM-A).

Example 17

A photoreceptor was produced in the same manner as in Example 1, except that polycarbonate resin (CTB-B) with a recurring unit shown in the following Structural Formula 9 was used as the binder resin for the charge generation layer and the charge transport layer, in place of the polycarbonate resin (CTB-A).

Structural Formula 9

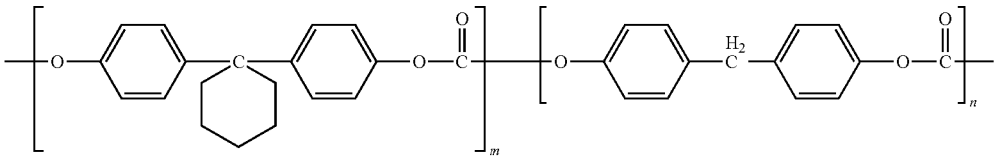

(CTB-B)

($m$:$n$ = 1:1)

Example 18

A photoreceptor was produced in the same manner as in Example 8, except that the polycarbonate resin (CTB-B) with the recurring unit shown in the Structural Formula 9 was used as the binder resin for the charge generation layer and the charge transport layer, in place of the polycarbonate resin (CTB-A).

Example 19

A photoreceptor was produced in the same manner as in Example 1, except that polycarbonate resin (CTB-C) with a recurring unit shown in the following Structural Formula 10 was used as the binder resin for the charge generation layer and the charge transport layer, in place of the polycarbonate resin (CTB-A).

Structural Formula 10

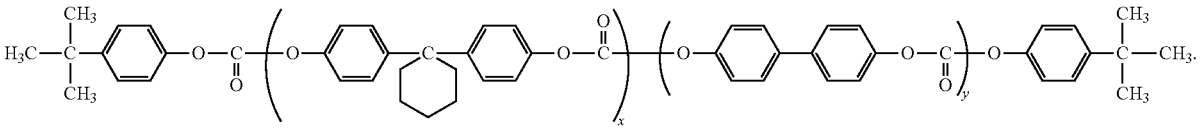

(CTB-C)

$x/(x+y) = 0.85$

Example 20

A photoreceptor was produced in the same manner as in Example 8, except that the polycarbonate resin (CTB-C) with the recurring unit shown in the Structural Formula 10 was used as the binder resin for the charge generation layer and the charge transport layer, in place of the polycarbonate resin (CTB-A).

Example 21

The photoreceptor of Example 2 was left in a hot and humid environment of 70° C. and 90% RH for 48 hours, to obtain a photoreceptor of Example 21. In this photoreceptor, the total amount of residual solvents contained in the charge generation layer and the charge transport layer was the same as that of the photoreceptor of Example 2, but the total moisture content of the films was 1.61%.

Example 22

A photoreceptor was produced in the same manner as in Example 2, except that the total amount of residual solvents was adjusted to 38 μg/cm$^2$ by drying the films in the vacuum dry furnace at 85° C. for 40 minutes.

Example 23

A photoreceptor was produced in the same manner as in Example 2, except that the total amount of residual solvents was adjusted to 45 μg/cm$^2$ by drying the films in the vacuum dry furnace at 85° C. for 30 minutes.

Comparative Example 1

A photoreceptor was produced in the same manner as in Example 2, except that the total amount of residual solvents was adjusted to 55 μg/cm$^2$ by drying the films in the vacuum dry furnace at 85° C. for 20 minutes.

Evaluation on the Photoreceptors

The performances of the photoreceptors were evaluated based on the following categories (1) to (4) on a scale of four symbols, ⓧ, O, Δ, and x. The symbol ⓧ represents excellent performance, O represents fair performance, Δ means that there is no particular problem in practical use of the photoreceptor, and x means that the photoreceptor is unusable. The obtained results are shown in the table below.

(1) Durability of Photoreceptor in Actual Machine

Durability tests were carried out on up to 30,000 sheets by using a commercially available monochrome laser printer HL-6050, manufactured by Brother Industries Ltd., under an environment of low temperature and low humidity (10° C., 20% RH), an environment of room temperature and normal humidity (24° C., 45% RH), and an environment of high temperature and high humidity (35° C., 90% RH), to evaluate print densities (image densities), resolutions (reproducibility of a white pattern consisting of a narrow line, and reproducibility of independent dots), fogging, image memories (ghost images in halftone), and levels of occurrences of point defects due to filming.

(2) Characteristics of Contamination by Member

With the photoreceptors and toner cartridges installed in a drum cartridge of the printer, the photoreceptors were left under an environment of 50° C. and 90% RH for five days, to check whether the surfaces of the photoreceptors have changed or not.

(3) Resistance to Grease

Grease used in the printer was adhered to the surfaces of the photoreceptors to examine whether or not the surfaces of the photoreceptors have changed five days later.

(4) Characteristics of Contamination by Sebum

Human sebum was adhered to the surfaces of the photoreceptors, and the presence/absence of cracks on the parts with sebum were examined after leaving the photoreceptors for 10 days.

TABLE 1

| | Image Quality in Durability Tests | | | | | Contamination Resistance | | |
|---|---|---|---|---|---|---|---|---|
| | Print Density | Resolution | Fogging | Memory | Point Defects | Member Contamination | Grease Contamination | Sebum Contamination |
| Ex.1 | ○ | ○ | ⊗ | ○ | ○ | ⊗ | ○ | ⊗ |
| Ex.2 | ○ | ○ | ⊗ | ○ | ○ | ⊗ | ○ | ⊗ |
| Ex.3 | ⊗ | ○ | ⊗ | ○ | ○ | ⊗ | ○ | ⊗ |
| Ex.4 | ⊗ | ○ | ⊗ | ○ | ○ | ⊗ | ○ | ⊗ |
| Ex.5 | ⊗ | ○ | ⊗ | ○ | ○ | ⊗ | ○ | ⊗ |
| Ex.6 | ⊗ | ○ | ⊗ | ○ | ○ | ⊗ | ○ | ⊗ |
| Ex.7 | ○ | ○ | ⊗ | ○ | ○ | ⊗ | ○ | ⊗ |
| Ex.8 | ○ | ○ | ⊗ | ⊗ | ○ | ⊗ | ○ | ○ |
| Ex.9 | ○ | ○ | ⊗ | ⊗ | ○ | ⊗ | ○ | ⊗ |
| Ex.10 | ⊗ | ⊗ | ⊗ | ⊗ | ○ | ⊗ | ○ | ○ |
| Ex.11 | ○ | ⊗ | ⊗ | ⊗ | ○ | ⊗ | ○ | ⊗ |
| Ex.12 | ⊗ | ⊗ | ⊗ | ⊗ | ○ | ⊗ | ○ | ○ |
| Ex.13 | ○ | ○ | ⊗ | ○ | ○ | ○ | ⊗ | ⊗ |
| Ex.14 | ○ | ○ | ⊗ | ⊗ | ○ | ○ | ⊗ | ○ |
| Ex.15 | ○ | ○ | ⊗ | ○ | ○ | ⊗ | ○ | ⊗ |
| Ex.16 | ○ | ○ | ⊗ | ⊗ | ○ | ⊗ | ○ | ○ |
| Ex.17 | ○ | ○ | ⊗ | ○ | ⊗ | ⊗ | ⊗ | ⊗ |
| Ex.18 | ○ | ○ | ⊗ | ⊗ | ⊗ | ⊗ | ⊗ | ○ |
| Ex.19 | ○ | ○ | ⊗ | ○ | ⊗ | ⊗ | ⊗ | ⊗ |
| Ex.20 | ○ | ○ | ⊗ | ⊗ | ⊗ | ⊗ | ⊗ | ○ |
| Ex.21 | ⊗ | Δ | Δ | Δ | ○ | ⊗ | ○ | ⊗ |
| Ex.22 | ○ | ○ | ⊗ | ○ | ○ | ⊗ | ○ | ○ |
| Ex.23 | ○ | ○ | ⊗ | ○ | ○ | ⊗ | ○ | Δ |
| Comp. Ex.1 | ○ | ○ | ⊗ | ○ | ○ | ⊗ | ○ | X |

According to the results in this table, it was confirmed that the photoreceptors of the examples with the reduced amount of residual solvents had no cracks by adhesion of sebum and had improved contamination resistance, and that stable, high image qualities were obtained by setting the moisture contents of the films in a predetermined range. However, the photoreceptor of the comparative example with the large amount of residual solvents did not have enough resistance to contamination by sebum and therefore had cracks generated on the surface of the photoreceptor.

According to these results, the present invention can provide a highly sensitive and highly durable electrophotographic photoreceptor, a method for manufacturing the same, and an electrophotographic apparatus using the same, the photoreceptor being applicable to a high-resolution and high-speed positively-charged electrophotographic apparatus, being excellent in operational stability, providing no image defects that are the results of cracks generated due to image memories or contamination by contact members, grease, or sebum, and being capable of stably providing high image qualities.

EXPLANATION OF REFERENCE NUMERALS

1 Conductive support
2 Charge transport layer
3 Charge generation layer
4 Undercoating layer
7 Electrophotographic photoreceptor
21 Charger (scorotron)
22 High voltage power supply
241 Developing roller
24 Developer
251 Feed roller
252 Feed guide
25 Sheet feeding member
26 Transfer electrode (transfer roller)
27 Paper powder removing member (sponge roller)
60 Electrophotographic apparatus
300 Photosensitive layer

The invention claimed is:

1. A layered, positively-charged electrophotographic photoreceptor, comprising:

a conductive support on which is provided a sequential stack comprised of:

a charge transport layer containing a first hole transport material and a first binder resin that is a bisphenol Z polycarbonate resin made of repeating units having a structural formula selected from the group consisting of (CTB-A), (CTB-B), and (CTB-C) as follows, that has a mass ratio between the first hole transport material and the first binder resin in the charge transport layer that ranges from 1:3 to 3:1, and a film thickness ranging from 5 μm to 30 μm, (CTB-A)

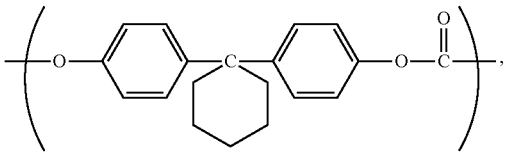

-continued (CTB-B)

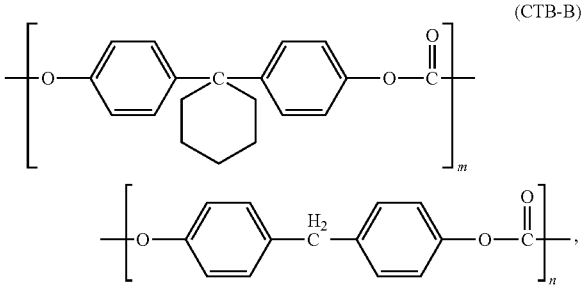

and (CTB-C)

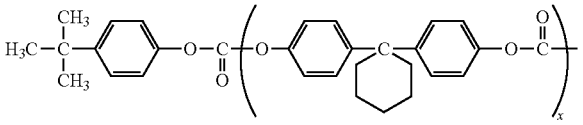

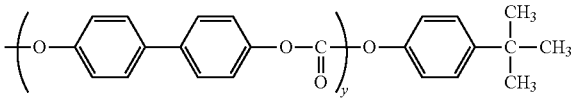

and (m:n = 1:1)
x/(x + y) = 0.85;

a charge generation layer containing a charge generation material comprising titanyl phthalocyanine, a second hole transport material, an electron transport material, and a second binder resin comprising a polycarbonate resin, and having a film thickness ranging from 5 μm to 30 μm, provided that a solvent used for forming the charge generation layer is dichloroethane, wherein the first hole transport material and the second hole transport material are comprised of a styryl-based compound having a triphenylamine skeleton that is a styryl-based compound selected from the group consisting of compounds of CTM-A, CTM-B, and CTM-C having structural formulas as follows:

(CTM-A)

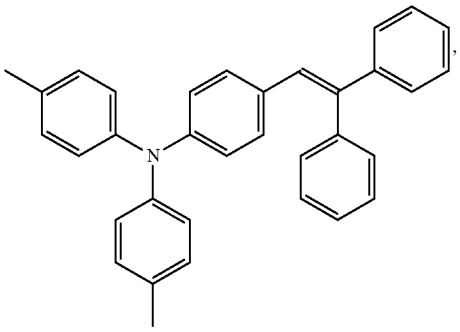

-continued (CTM-B)

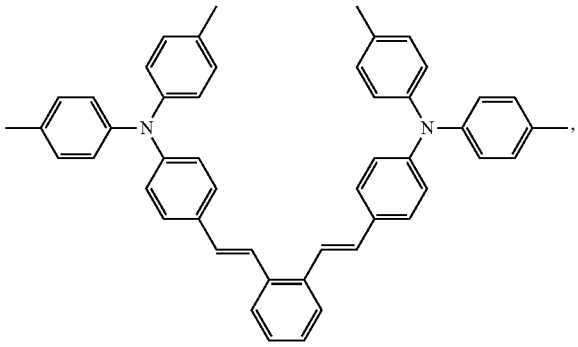

and (CTM-C)

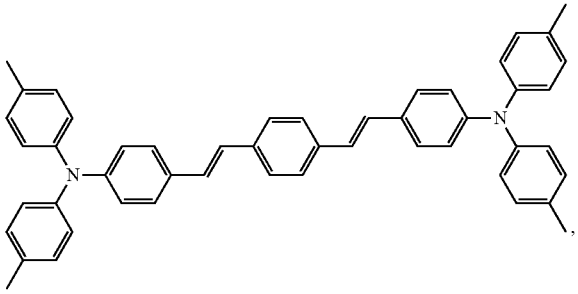

wherein the charge generation layer and the charge transport layer have a total amount of residual solvent that is 50 μg/cm$^2$ or less, wherein the charge generation layer and the charge transport layer have a total moisture content ranging from 0.05 to 1.5 mass %, and wherein the first hole transport material and the second hole transport material are the same, and wherein the first binder resin and the second binder resin are the same so that impact of elution of the first hole transport material and the first binder resin from the charge transport layer into the charge generation layer is minimized when the charge generation layer is applied.

2. The electrophotographic photoreceptor according to claim 1, wherein the charge generation layer and the charge transport layer have a total amount of residual solvent that ranges between 5 μg/cm$^2$ and 50 μg/cm$^2$, inclusive.

3. The electrophotographic photoreceptor according to claim 1, wherein the charge generation layer and the charge transport layer have a total amount of residual solvents that is 25 μg/cm$^2$ or less.

4. The electrophotographic photoreceptor according to claim 1, wherein the charge transport layer further comprises a plasticizer that is a triphenylamine having a low molecular weight.

5. A method for manufacturing a layered, positively-charged electrophoto-graphic photoreceptor comprised of:

a conductive support on which is provided a sequential stack comprised of:

a charge transport layer containing a first hole transport material and a first binder resin that is a bisphenol Z polycarbonate resin made of repeating units having a structural formula selected from the group consisting of (CTB-A), (CTB-B), and (CTB-C) as follows.

(CTB-A)

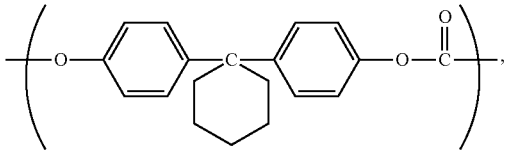

(CTB-B)

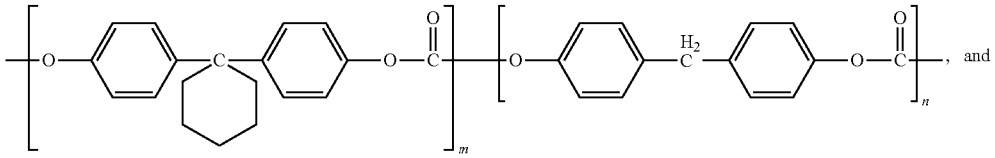

and (CTB-C)

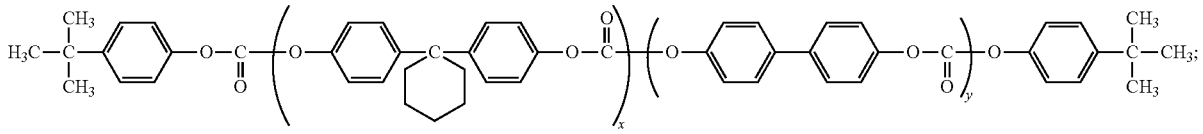

(m:n = 1:1)
x/(x + y) = 0.85 that has a mass ratio of the first hole transport material and the first binder resin ranging from 1:3 to 3:1, and that has a film thickness ranging from 5 μm to 30 μm; and a charge generation layer containing a charge generation material comprising titanyl phthalocyanine, a second hole transport material, an electron transport material, and a second binder resin comprising a polycarbonate resin, and having a film thickness ranging from 5 μm to 30 μm, provided that a solvent used for forming the charge generation layer is dichloroethane, wherein the first hole transport material and the second hole transport material are comprised of a styryl-based compound having a triphenylamine skeleton that is a styryl-based compound selected from the group consisting of compounds of CTM-A, CTM-B, and CTM-C having structural formulas as follows:

(CTM-A)

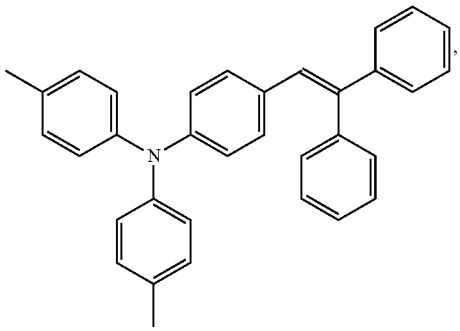

(CTM-B)

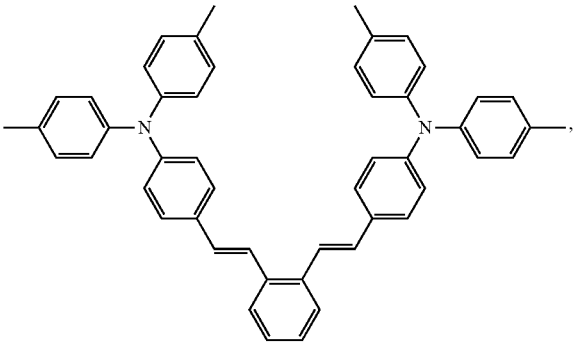

and (CTM-C)

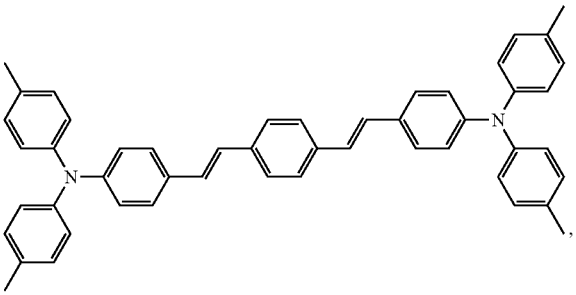

wherein the charge generation layer and the charge transport layer have a total amount of residual solvent that is 50 μg/cm$^2$ or less, wherein the charge generation layer and the charge transport layer have a total moisture content ranging from 0.05 to 1.5 mass %, and wherein the first hole transport material and the second hole transport material are the same, and wherein the first binder resin and the second binder resin are the same so that impact of elution of the first hole transport material and the first binder resin from the charge transport layer into the charge generation layer is minimized when the charge generation layer is applied, the method comprising:

providing a conductive support;

dissolving the first binder resin and the first hole transport material in a first solvent to provide a charge transport layer coating liquid;

mixing the second binder resin, the second hole transport material, the electron transport material, and the charge generation material comprising titanyl phthalocyanine in said dichloroethane to provide a charge generation layer coating liquid;

dip coating the conductive substrate into the charge transport layer coating liquid to provide a charge transport coating thereon;

hot-air drying the charge transport coating to provide a charge transport layer;

dip coating the conductive substrate having the charge transport layer thereon into the charge generation layer coating liquid to form a charge generation coating on the charge transport layer;

hot-air drying the charge generation coating to provide a charge generation layer; and drying the charge transport layer and the charge generation layer under reduced pressure to provide the total amount of residual solvents that is 50 μg/cm$^2$ or less.

6. An electrophotographic apparatus which is equipped with the electrophotographic photoreceptor as defined in claim 1.

7. The electrophotographic photoreceptor according to claim 1, wherein the charge generation layer has a mass ratio between sum of the contents of the charge generation material, the electron transport material and the hole transport second material, and the binder resin ranging between 35:65 to 65:35.

8. The electrophotographic photoreceptor according to claim 7, wherein the charge generation layer has a mass ratio between the electron transport material and the hole transport second material ranging from 5:1 to 4:2.

9. The electrophotographic photoreceptor according to claim 8, wherein the charge generation layer has a content of the charge generation material ranging from 1 to 2.5% by mass.

* * * * *